United States Patent [19]

Kumagai

[11] 3,955,686

[45] May 11, 1976

[54] APPARATUS FOR SUPPLYING THIN, FLAT ARTICLES

[75] Inventor: Naoki Kumagai, Yokohama, Japan

[73] Assignee: Itogihan Company, Ltd., Tokyo, Japan

[22] Filed: Mar. 25, 1975

[21] Appl. No.: 561,996

[52] U.S. Cl. ..... 214/1 Q; 214/6 C; 214/130 R; 271/3.1; 271/146

[51] Int. Cl.[2] ..... B65G 59/08

[58] Field of Search ..... 214/1 Q, 1 QE, 6 C, 214/6 D, 8.5 R, 8.5 A, 130 R; 271/3.1, 1.46, 151

[56] References Cited

UNITED STATES PATENTS

| | | | |
|---|---|---|---|
| 2,776,831 | 1/1957 | Shields | 214/6 C X |
| 3,422,969 | 1/1969 | Miller et al. | 214/6 D |
| 3,643,939 | 2/1972 | Nussbaum | 214/6 C X |
| 3,741,413 | 6/1973 | Friel | 214/QE X |
| 3,900,115 | 8/1975 | Kumagai | 214/1 Q |

*Primary Examiner*—Albert J. Makay
*Assistant Examiner*—L. J. Paperner
*Attorney, Agent, or Firm*—Oblon, Fisher, Spivak, McClelland & Maier

[57] ABSTRACT

An apparatus for supplying thin, flat articles has a reversing means for reversing the articles. The reversing means includes a bottom surface supporting part and an edge supporting part which is perpendicular to the bottom surface supporting part. The apparatus also has a conveyer means by which the reversed articles are received and fed. The edge supporting part has at least one fixed member which is fixed to the bottom surface supporting part and at least one sliding member which is slidably associated with the fixed member so that the length of the edge supporting part can be changed.

4 Claims, 9 Drawing Figures

APPARATUS FOR SUPPLYING THIN, FLAT ARTICLES

BACKGROUND OF THE INVENTION

The present invention relates generally to an apparatus for supplying thin, flat articles, and more particularly to an apparatus for supplying cardboards to machines which are used in various steps of making cartons from the cardboards.

Various machines have been developed for the making of cartons from cardboards. For example, machines have been developed for printing, cutting, and the like. But there has been a need for machines to automatically supply the cardboards to other processing machines. In many cases of supplying cardboards for the making of cartons, the reversal of the cardboards, from their stacked condition is necessary.

The inventor disclosed a machine in his copending application, Ser. No. 308,820, filed on Nov. 22, 1972, and now U.S. Pat. No. 3,900,115. The machine enables automatical supplying of cardboards after reversing thereof from their stacked condition. But the machine has a large height and a large length. Therefore, it is necessary to reduce the height and length of the machine.

SUMMARY OF THE INVENTION

Accordingly, it is an object of this invention to provide an apparatus for supplying thin, flat articles, wherein the thin, flat articles, such as for example, cardobards, wood plates, metal plates or the like, can be automatically reversed and supplied from a stacked condition thereof, and the apparatus can be made to have a short height and a short length so as to reduce its cost and become a more compact machine which is suitable for use thereof.

The foregoing object is achieved according to this invention through the provision of an apparatus for supplying thin, flat articles comprising a reversing means which reverses piled articles by rotating the articles about one of their side edges. The reversing means has a bottom surface supporting part for supporting the bottom surface of the piled articles and an edge supporting part which is disposed perpendicular to the bottom surface supporting part, for supporting the side edges of the articles. The edge supporting part has at least one fixed member which is fixed to the bottom surface supporting part and at least one sliding member which is slidably associated with the fixed member so as to change the length of the edge supporting part. The articles can be reversed by lifting and rotating thereof from their stacked condition by means of the reversing means. The apparatus also has a conveyor means which receives the reversed articles and feeds them to a subsequent position. The edge supporting part of the reversing means is able to pass through the supporting surface of the conveyor means at its stretched condition and return to the initial position while becoming a contracted condtion so as to maintain its top portion under the supporting surface of the conveyor means.

BRIEF DESCRIPTION OF THE DRAWINGS

Various other objects, features and attendant advantages of the present invention will be more fully appreciated as the same becomes better understood from the following detailed description when considered in connection with the accompanying drawings wherein.

DETAILED DESCRIPTION OF A PREFERRED EMBODIMENT

Figures 1, 6:
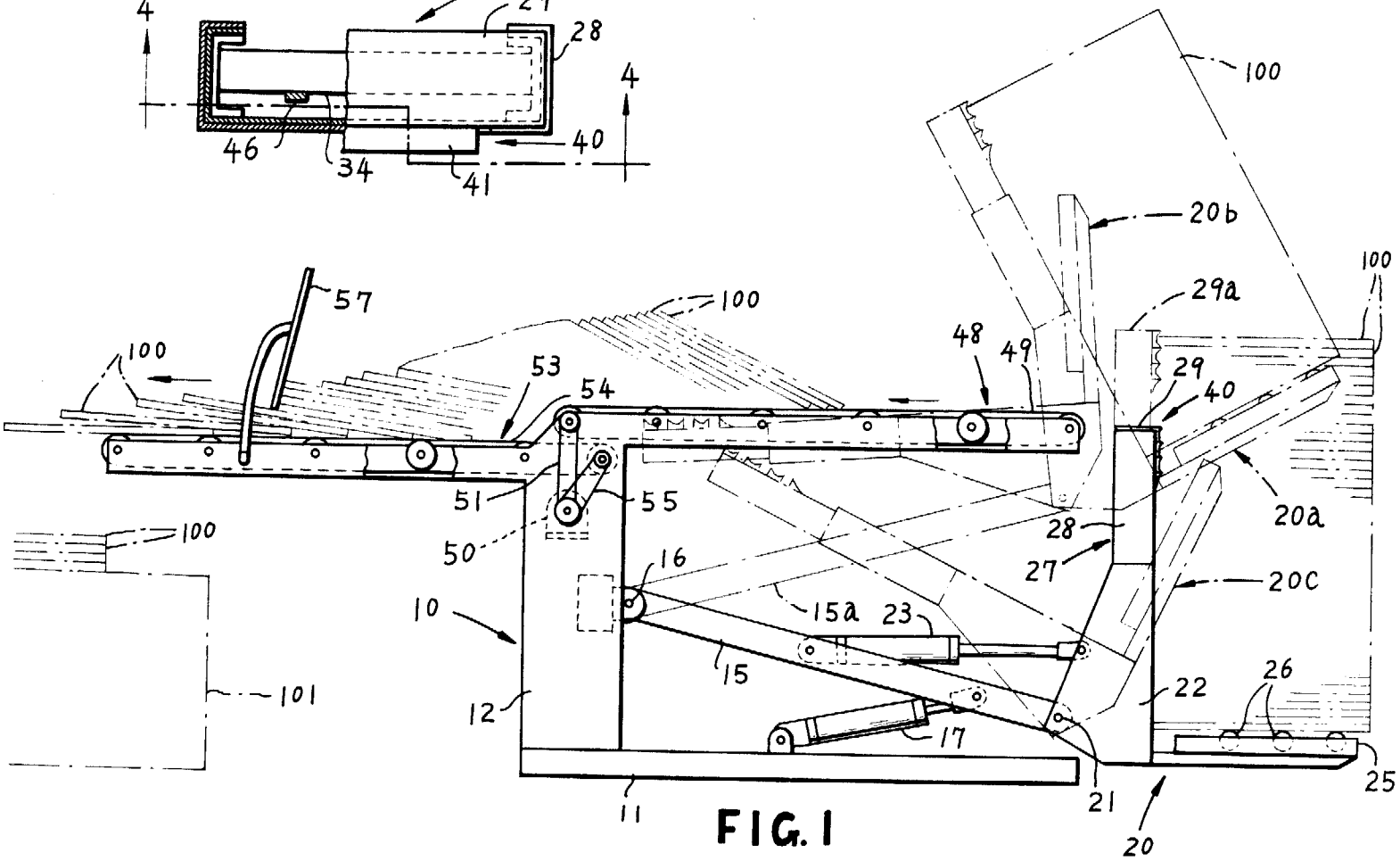
FIG. 1 is a side elevational view illustrating the apparatus incorporating the present invention of which a part is cut-away.
FIG. 6 is a plan view of the edge supporting part with the edge clearance making device in section taken along the line 6—6 of FIG. 4.
Figure 2:
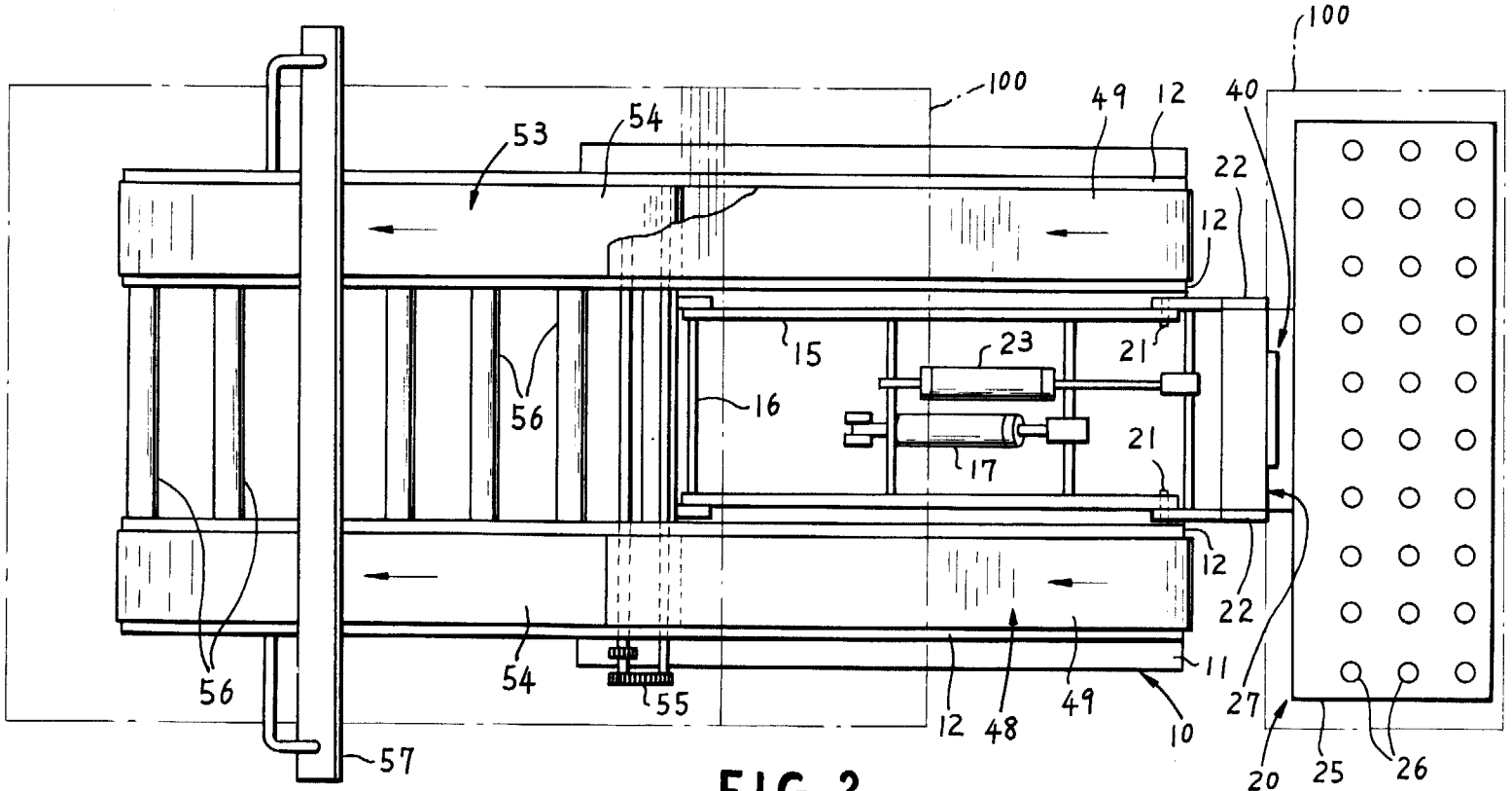
FIG. 2 is a plan view of the apparatus shown in FIG. 1 of which a part is cut-away.
Figure 3:
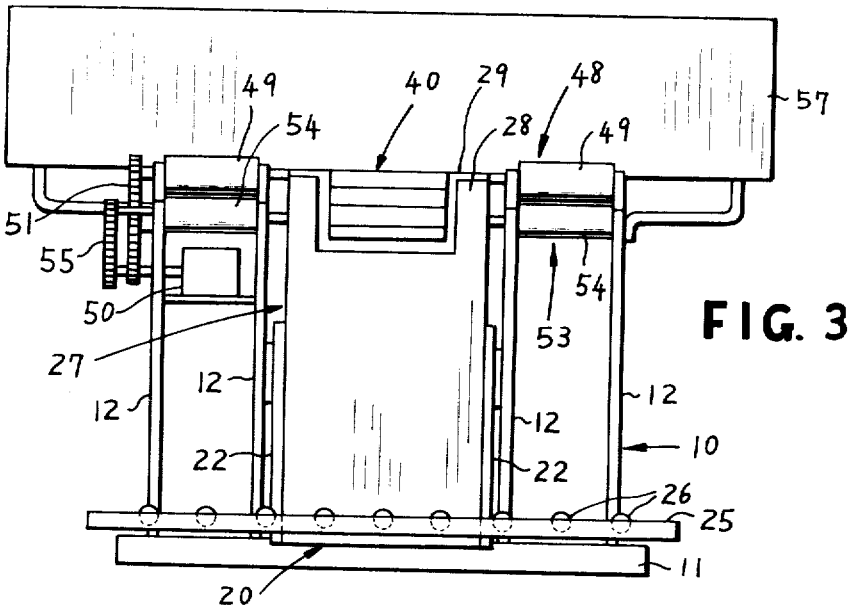
FIG. 3 is a front view of the apparatus shown in FIGS. 1 and 2.
Figure 4:
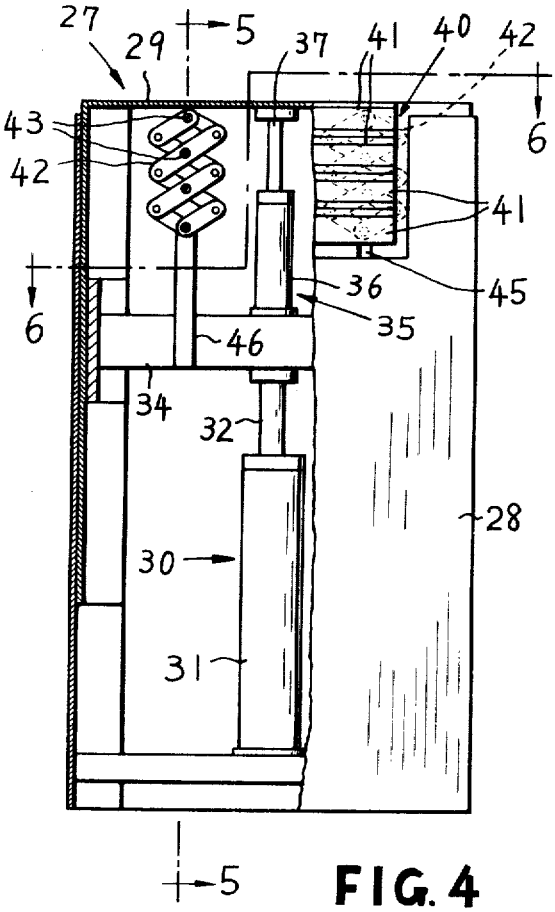
FIG. 4 is a front view of an edge supporting part with an edge clearance making device utilized within the apparatus of the present invention in section taken along the line 4—4 of FIG. 6.
Figure 5:
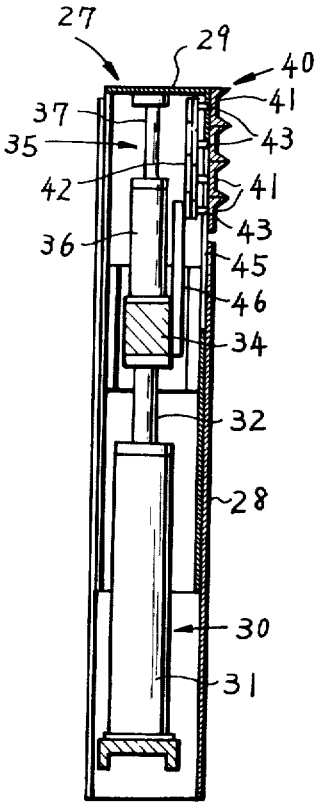
FIG. 5 is a sectional view taken along the line 5—5 of FIG. 4.

Referring now to the drawings, and more particularly to FIGS. 1–3 thereof, there is shown an apparatus for supplying cardboards constructed according to this invention, the apparatus has a base generally indicated by the reference character 10 which includes a supporting plate 11 and four T-shaped vertical members 12 fixed on the supporting plate at lower ends thereof.

An arm member 15 is pivotally connected to the base 10 by means of an axle 16. The arm member 15 can be rotated to a position 15a in FIG. 1 by means of an oil pressure actuating device 17.

The apparatus has a reversing device generally indicated by a reference character 20 which is pivotally connected to both ends of the arm member 15 by means of pins 21 at a pair of side plates 22 thereof. The reversing device 20 can be rotated by means of an oil pressure actuating device 23.

The reversing device 20 has a bottom surface supporting part 25 which has many balls 26 rotatably attached thereon and supports a bottom surface of piled cardboards 100 in its horizontal condition. The cardboards may be brought to the reversing devices by means of a pallet, not shown, or the like. The reversing device 20 also has an edge supporting part 27 which is vertically elongated from the rear end of the bottom surface supporting part 25 so as to support the side edges of the cardboards 100 at a time of reversing thereof.

Figure 7:
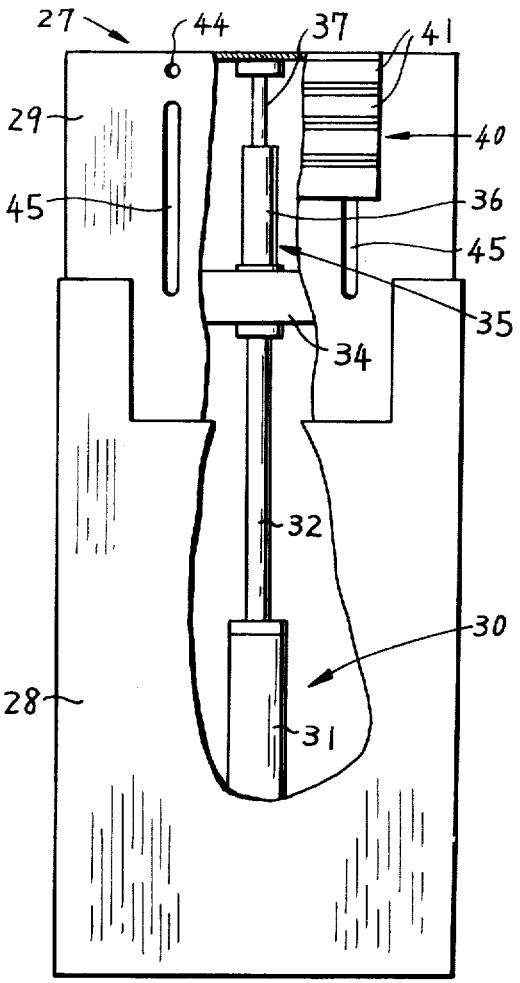
FIGS. 7 and 8 are front views illustrating other conditions of the edge supporting part with the edge clearance making device of FIG. 4 of which a part is cut-away.

Referring also to the FIGS. 4-8, the edge supporting part 27 has a fixed member 28 which is fixed to the bottom surface supporting part 25. The side plates 22 are fixed to both side surfaces of the fixed member 28. The edge supporting member 27 also has a sliding member 29 which is slidably guided by the inner surface of the fixed member 28. An oil pressure actuating device 30 is disposed in the edge supporting part 27, which has a cylinder 31 fixed to the fixed member 28 at the lower end thereof and a piston rod 32. The upper end of the piston rod is fixed to a movable member 34 which is slidably guided by the sliding member 29 at both ends thereof. An oil pressure actuating device 35 is also shown, which has a cylinder 36 fixed to the movable member 34 at lower end thereof and a piston rod 37 fixed to the sliding member 29 at upper end thereof. The oil pressure actuating device 30 is able to lift the sliding member 29 with the movable member 34 as shown in FIG. 7 from a condition shown in FIG. 4, the lifting length of the sliding member is adjustable.

Figure 8:
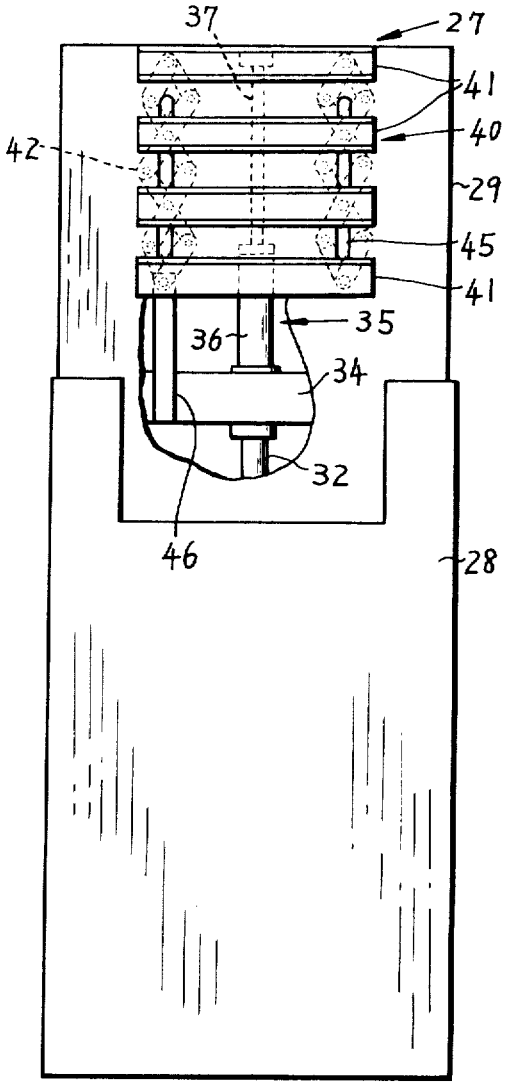

An edge clearance making device 40 is shown, which is associated with the sliding member 29 and has a plurality of acting members 41 positioned at front surface of the sliding member 29 and a pair of pantograph devices 42 positioned at inside space of the sliding member 29. Each of the pantograph devices 42 has pins 43 which are fixed to each of the acting members 41 respectively, the uppermost pin 43 being fixed to the sliding member 29 through a hole 44, the other pins 43 being movably positioned through a slit 45 vertically disposed on the sliding member 29. The lowest pin 43 of each of the pantograph devices 42 is fixed to the movable member 34 by means of a connecting member 46. The pantograph devices 42 are contracted in the conditions shown in FIGS. 4 and 7. The oil pressure actuating device 35 is able to lift the sliding member 29 as shown in FIG. 8 from the condition shown in FIG. 7, wherein the pantograph devices 42 become their stretched condition and the acting members 41 become separated condition each other.

Referring again to FIGS. 1-3, there is shown a conveyor assembly generally indicated by the reference character 48, which includes a pair of conveyors 49 being driven by means of a motor 50 and a chain 51, each of the conveyors 49 is positioned between the uppermost front extending portions of each pair of the vertical members 12. Another conveyor assembly 53 is shown at a succeeding postion of the conveyor assembly 48, which includes a pair of conveyors 54 being driven by means of the motor 50 and a chain 55, each of the conveyors 54 is positioned between the uppermost rear extending portions of each pair of the vertical members 12 and a little lower than each of the conveyors 49. A plurality of rollers 56 are rotatably installed between the conveyors 54. 57 designates a restricting member which is fixed to the vertical members 12 positioned at both outsides. The lower end of the restricting member is spaced a suitable distance from the supporting surface of the conveyor assembly 53.

The operation of the apparatus will now be described. Total height of the cardboards 100 to be piled upon the bottom surface supporting part 25 is substantially constant owing to the kind of the working. Therefore, the sliding member 29 is firstly lifted to a position as shown by 29a in FIG. 1 by means of the oil pressure actuating device 30 to obtain a suitable length on the edge supporting part 27 which is preferable to be a little higher than the total height of the piled cardboards 100 upon the bottom surface supporting part 25. If the total height of the piled cardboards 100 is less than the vertical length of the fixed member 28, it is not necessary to lift the sliding member 29. Then, the cardboards 100 are piled on the bottom surface supporting part 25.

Figure 9:
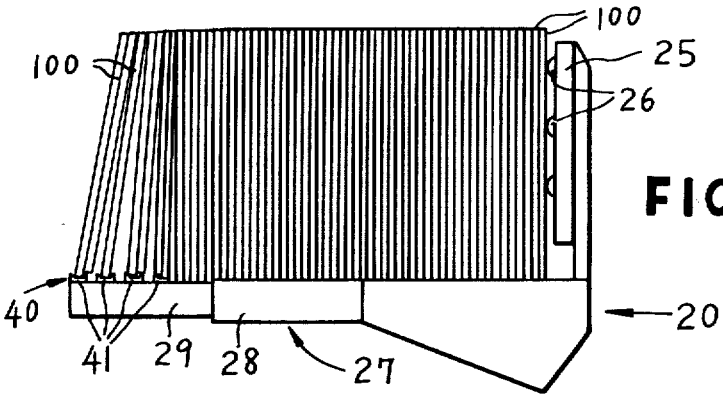
FIG. 9 is a side view of the reversing device with the edge clearance making device while undergoing reversal of cardboards, illustrating the clearance made between lower side edges of the cardboards.

The arm member 15 is rotated to the position 15a in FIG. 1 by means of the oil pressure actuating device 17, the reversing device 20 therefore be lifted and rotated to a position **20*a* thus transporting therewith the stacked cardboards 100. Subsequently, the reversing device 20 is rotated to a position 20*b* so that the edge supporting part 27 be disposed in a space between the conveyors 49 by means of the oil pressure actuating device 23, the stacked cardboards 100 therefore being reversed about the side edges supported by the edge supporting part 27, so as to face a direction opposite to the direction of the cardboards initially faced prior to reversal. The sliding member 29 is moved so as to make the space between each pair of acting members 41 by means of the oil pressure actuating device 35, while the reversing device 20 is rotated from the position 20*a* to a position where the cardboards 100 are vertically oriented. Thus, a plurality of clearances are made between the lower side edges of the cardboards as shown in FIG. 9. The clearances are effective to avoid a phenomenon which occurs at the moment of reversal of the cardboards 100**, such that some of the initial lower cardboards become lapped upon, and project forwardly over the upper cardboards such that the cardboards cannot in fact be fed in the proper sequence.

Subsequently, the arm member 15 is rotated to the initial position shown by full line in FIG. 1 by means of the oil pressure actuating device 17, therefore the reversing device 20 being moved so as to pass through the supporting surface of the conveyor assembly 48 to a position 20c in FIG. 1, the reversed cardboards being received and fed to a direction shown by an arrow head in FIG. 1 by means of the conveyor assembly 48. Then, the reversing device 20 is rotated to the initial position by means of the oil pressure actuating device 23, and at the same time, the edge supporting part 27 is connected to the initial condition by means of the oil pressure actuating devices 30 and 35, therefore the top portion of the sliding member 29 being maintained under the supporting surface of the conveyor assembly 48 so as to avoid contacting with the cardboards on the conveyor assembly 48.

The cardboards 100 to be fed by the conveyor assembly 48 are received and fed by the conveyor assembly 53, the cardboards becoming a stacked condition with their forward edges contacting the restricting member 57 and the lower ones thereof passing through the space between the lower end of the restricting member 57 and the supporting surface of the conveyor assembly 53. The cardboards 100 are fed in a condition whereby they partly overlap each other after passing the space between the lower end of the restricting member 57 and the supporting surface of the conveyor assembly 53. Then, the cardboards 100 are fed to and stacked upon a processing machine 101.

The apparatus described above has a number of advantages, particularly the apparatus can be made to have a short height and a short length owing to the reason that the reversing device is able to return to the initial position while the edge supporting part is reducing the length thereof so as to avoid its contacting with the cardboards received by the conveyor assembly 48 after reversing of the cardboards.

The foregoing is of course considered as illustrative only of the principle of the invention. Obviously, numerous modifications and variations of the present invention are possible in light of the above teachings. For example, the edge clearance making device may not be installed, but in this case, the sliding member 29 will be fixed to the movable member 34. Furthermore, the edge supporting part of the reversing device may have a plurality of fixed members and sliding members; each of the sliding members is slidably associated with each of the fixed member; the conveyor assembly which receives the cardboards reversed by the reversing device has a plurality of conveyors; and the fixed members with the sliding members pass through the supporting surface of the conveyor assembly while becoming alternating fashion with the conveyors. The apparatus can of course be available for supplying other thin, flat articles, such as, for example, plywood, metal plates, or the like.

What is claimed as new and desired to be secured by letters patent of the United States is:

1. In an apparatus for supplying thin, flat articles having a reversing means for reversing the direction toward which said articles face while in piled condition and a conveyor means for receiving and feeding said reversed articles, said reversing means has a bottom surface supporting part and an edge supporting part disposed perpendicular to said bottom surface supporting part and is able to reverse said articles from a piled condition of said articles upon said bottom surface supporting part to a reversed condition of said articles on said edge supporting part by lifting and rotating said articles, said edge supporting part is able to return to the initial position by passing downwardly through a supporting surface of said conveyor means after reversing of said articles, said edge supporting part of said apparatus comprises at least one fixed member which is fixed to said bottom surface supporting part and at least one sliding member which is slidably associated with said fixed member so as to change the length of said edge supporting part, said edge supporting part is able to pass through the supporting surface of said conveyor means at a stretched condition thereof after reversal of said articles and return to an initial position while becoming a contracted condition thereof.

2. An apparatus as set forth in claim 1, wherein said edge supporting part is able to maintain the top portion thereof lower than the supporting surface of said conveyor means while returning to the initial position after passing through the supporting surface of said conveyor means.

3. An apparatus as set forth in claim 1, wherein said conveyor means has a pair of conveyors disposed parallel each other, said edge supporting part is able to pass through a space between said conveyors after reversal of said articles.

4. An apparatus as set forth in claim 1, wherein said apparatus further comprises a clearance making means which is associated with said sliding member for making at least one clearance space between a pair of side edges of said articles while said articles are being reversed.

* * * * *